US008297656B2

(12) United States Patent
Arbogast

(10) Patent No.: US 8,297,656 B2
(45) Date of Patent: Oct. 30, 2012

(54) ALL-TERRAIN ROLLER SKATE

(76) Inventor: Jean-Claude Arbogast, Harthouse (FR)

( * ) Notice: Subject to any disclaimer, the term of this patent is extended or adjusted under 35 U.S.C. 154(b) by 283 days.

(21) Appl. No.: 12/734,963

(22) PCT Filed: Dec. 3, 2008

(86) PCT No.: PCT/FR2008/001686

§ 371 (c)(1),
(2), (4) Date: Jun. 4, 2010

(87) PCT Pub. No.: WO2009/101284

PCT Pub. Date: Aug. 20, 2009

(65) Prior Publication Data

US 2010/0253057 A1 Oct. 7, 2010

(30) Foreign Application Priority Data

Dec. 4, 2007 (FR) ..... 07 08446

(51) Int. Cl.
*A63C 1/00* (2006.01)
*A63C 17/02* (2006.01)

(52) U.S. Cl. ..... 280/844; 280/11.221

(58) Field of Classification Search ..... 280/844, 280/11.221, 11.222, 11.223, 11.232
See application file for complete search history.

(56) References Cited

U.S. PATENT DOCUMENTS 675,824 A * 6/1901 Fohr ..... 280/844
889,946 A * 6/1908 Miller ..... 280/844
1,260,692 A * 3/1918 Madsen ..... 280/11.222
1,583,114 A * 5/1926 Bierly ..... 280/844
2,412,290 A 12/1946 Rieske
5,382,052 A * 1/1995 Tarng ..... 280/844
5,390,958 A 2/1995 Soo
5,398,949 A * 3/1995 Tarng ..... 280/11.206
5,413,380 A * 5/1995 Fernandez ..... 280/844
5,580,096 A * 12/1996 Freilich ..... 280/844
6,276,696 B1 * 8/2001 Wong ..... 280/11.222
6,416,063 B1 * 7/2002 Stillinger et al. ..... 280/11.223
6,425,587 B1 7/2002 Moon
2006/0138735 A1 6/2006 Jeon

FOREIGN PATENT DOCUMENTS

DE 890173 8/1953
DE 298 09 894 12/1998
DE 198 25 852 12/1999
DE 203 15 138 1/2004
FR 499558 2/1920

(Continued)

*Primary Examiner* — J. Allen Shriver, II
*Assistant Examiner* — James M Dolak
(74) *Attorney, Agent, or Firm* — Law Offices of Steven W. Weinrieb

(57) ABSTRACT

In-line roller skate (1) comprising in-line wheels (2) around which travels an endless rolling support (4) of the belt type, having regular transverse notches (40). At least the rear wheel (24) is mounted in such a way as to allow horizontal sliding, and at least the front wheel (9) is mounted in such a way as to allow inclined forward sliding along an elongate slot opening (12) formed in the side walls (13, 14) of the frame (6), so that the tension in the rolling belt keeps the axis of rotation (5) of the wheel at the bottom end of the slot. At least one element (27) is in rolling bearing contact with the lower portion of the rolling belt. This belt is preferably cylindrical in section, with its inner surface (28) housed in mating grooves (3) around the perimeter of the wheels. The skate may include a stone guard (45).

30 Claims, 8 Drawing Sheets

FOREIGN PATENT DOCUMENTS

| | | |
|---|---|---|
| FR | 2187369 | 1/1974 |
| WO | WO 94/27693 | 12/1994 |
| WO | WO 98/11961 | 3/1998 |
| WO | WO 2006/038897 | 4/2006 |

* cited by examiner

ALL-TERRAIN ROLLER SKATE

The present invention concerns an improved roller skate of the in-line and all-terrain type. More particularly, the invention relates to an in-line roller skate comprising a belt mounted rolling on the wheels of the skate.

Nowadays, in-line roller skates, generally called "rollers," do not permit rolling in satisfactory fashion on a soft or uneven terrain or a terrain obstructed, for example, by bits of gravel. In effect, the presence of a small obstacle, such as a pebble, between the wheels of the skate may block the latter and result in falling of the user. In addition, although various solutions consisting in incorporating a cushioning system between the shoe part and the block fixing the wheels or the wheels themselves have been considered, these solutions have proved to be unsatisfactory, and the roller skates cannot be used on rough, difficult, uneven and uncomfortable ground.

Lastly, the wheels of traditional in-line roller skates have a tendency to sink into soft ground, which makes their use quite difficult, notably on loose ground or the like.

A rolling comfort superior to that of the initial in-line roller skates has been obtained by not having them roll directly on the external perimeter of the wheels but on an endless rolling support traveling around the wheels of the skate. In effect, with this type of skates, the bearing surface of the roller skates on the ground is greater and the user feels the unevenness in the ground less when he is rolling.

The object of the present invention is to provide an all-terrain in-line roller skate comprising an endless rolling support traveling around the wheels of the skate which is particularly well adapted to rolling on a soft, uneven or obstructed terrain and offers the best possible comfort.

To solve this technical problem, a variety of devices has been proposed.

PCT application No. WO 98/11961, in the name of RUSS, discloses for example an all-terrain in-line roller skate comprising an endless belt traveling around the wheels of the skate in the manner of a caterpillar. This endless belt has a flat external rolling surface and a width sufficient to allow attenuation of the impacts produced by the presence of small obstacles or imperfections of the ground. Nevertheless, even if the user feels the unevenness of the ground less when he is rolling, the flat shape of the external surface of the roller belt considerably increases the frictional surface between the endless belt and the ground, which is translated rolling, the flat shape of the external surface of the roller belt considerably increases the frictional surface between the endless belt and the ground, which is translated into reduced speed and premature fatigue of the user. Moreover, a rolling belt according to the RUSS application permits only horizontal use of the roller skates, which proves to be constricting and very uncomfortable in practice and does not permit all skating techniques.

Another solution is disclosed in PCT application No. WO 94/27693 in the name of FREILICH, in which an all-terrain in-line roller skate comprises an endless belt traveling around the wheels of the skate in the manner of a caterpillar, this belt being made up of a plurality of articulated elements so as to form a closed loop. These articulated elements are designed to engage in each other when they are found in the lower portion of the loop in order to form an arc defining a curved bearing surface. However, in addition to being particularly costly, the rolling belt of the FREILICH application has a tendency to capture gravel or other bits of debris between the articulated elements in the front loop portion where the distal portions of the articulated elements go away from each other. These bits of gravel or other materials thus captured then not only prevent the articulated elements from forming the curved bearing surface, but in addition risk blocking and severely damaging the rolling belt. Lastly, in use, rolling on a rolling belt made up of a plurality of articulated elements has been found to be uncomfortable and noisy, with the user feeling numerous vibrations and even jolts, even on flat and smooth terrain, caused by the articulated elements themselves.

Nevertheless, current roller skates, even if they are of the in-line type with endless rolling support, do not provide sufficient comfort making it possible, for example, to move on gravel, on grass, or on any other generally difficult terrain.

To solve this technical problem, the in-line roller skate having an endless rolling support of belt type according to the invention comprises numerous improvements which may be used jointly or independently in order to considerably improve rolling comfort.

Among these improvements may be mentioned the following principal ones:

- a mounting having the effect of suspension at least for the axis of rotation of the front wheel, allowing cushioning of the unevennesses in the ground,
- a mounting allowing sliding at least for the axis of rotation of the rear wheel, permitting the tension of the endless rolling support,
- the provision of at least one rolling bearing element on the internal face of the lower portion of the endless rolling support, which makes it possible to facilitate passage of the endless rolling support between the wheels and to keep it on a rectilinear path,
- an external surface of semicircular shape in section for the endless rolling support, which makes for ease in turning and makes it possible to considerably reduce the frictional surface between the endless rolling support and the ground,
- an internal surface of semicircular, trapezoidal, triangular, square or other shape in section for the endless rolling support, which makes it possible to improve retention of the endless rolling support in the grooves of the wheels,
- a rear structure with regular transverse notches cut into it, on the internal face of the endless rolling support of belt type, which permits easier deformation of the endless rolling support on the end wheels, procuring easier, more rapid and much quieter rolling and return movement of the endless rolling support, and
- a stone guard provided at the front of the roller skate, permitting protection of the movable parts of the roller skate against gravel and the like.

Other features and advantages of the invention will appear upon reading of the detailed description to follow, this description being given in reference to the accompanying drawings, wherein.

The roller skate according to the present invention will now be described in detail, with reference to FIGS. 1 to 31. Equivalent elements shown in the various figures will bear the same numerical references.

In the continuation of this description, the notions of high and low, lower and upper, etc., will be defined according to the orientation adopted by the device shown in the various figures. It is evident that this orientation will not necessarily be preserved in use.

The direction of forward displacement of a skate according to the invention is shown in certain figures by a white arrow.

Figure 1:
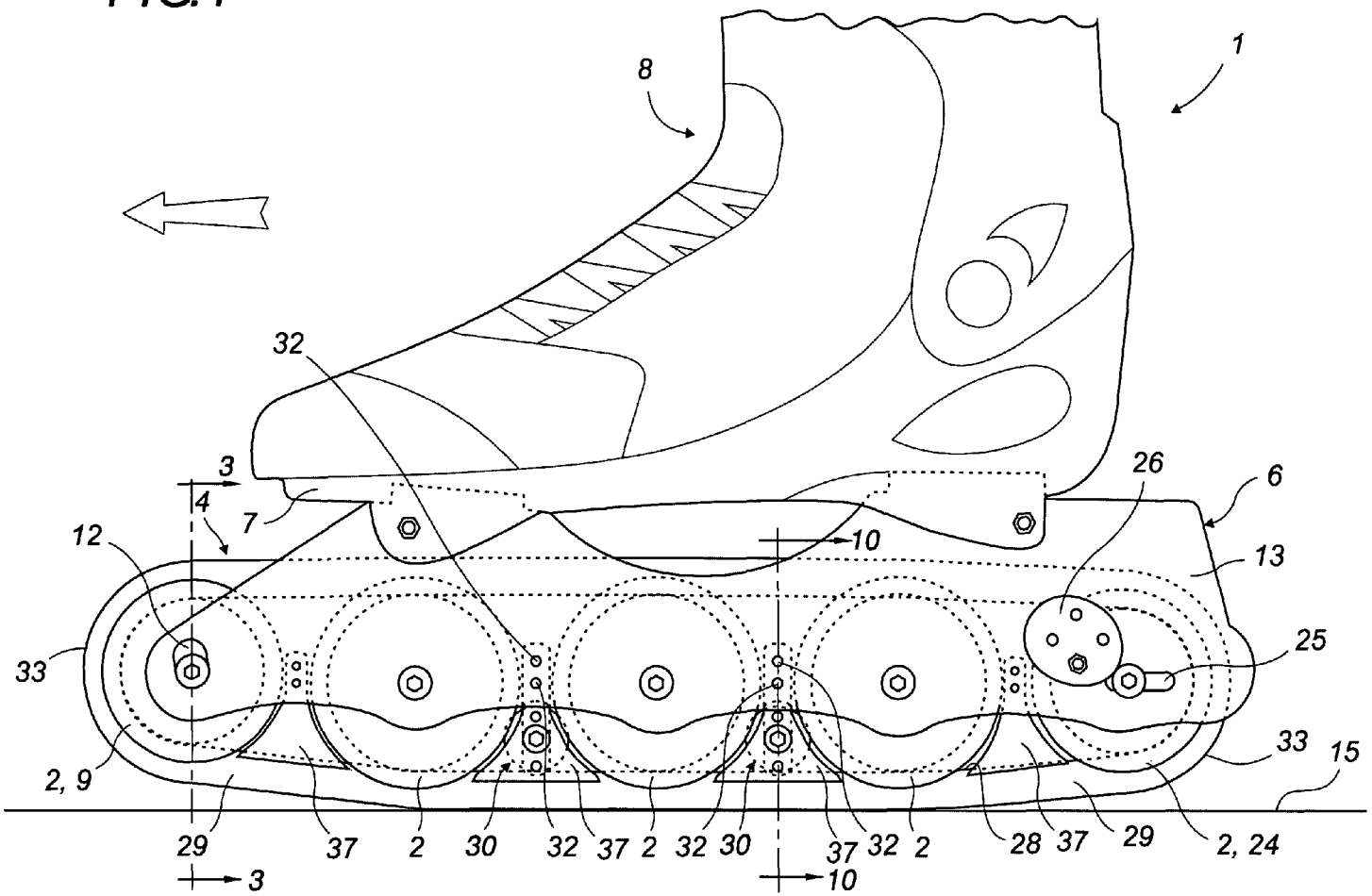
FIG. 1 is a general profile view of an all-terrain in-line roller skate comprising a variety of improvements according to the invention.

The figures are given solely by way of example and are not to be interpreted in a restrictive manner. For purposes of simplification, most of the figures, notably FIG. 1, show a roller skate according to a preferred embodiment of the invention and comprising a great number of improvements simultaneously. However, it must be understood that a roller skate according to the invention does not necessarily comprise all the improvements of the invention, but may be limited to the basic version or may comprise any number of them. Similarly, the number of elements, such as for example the wheels, the shape of the means and their positions, are not to be interpreted in a restrictive manner.

As shown in FIG. 1, in general fashion, the invention concerns an improved all-terrain skate 1 of in-line-wheel type, comprising a series of wheels 2, having for example groove 3, mounted aligned, and on which is carried rolling an endless rolling support 4 of belt type. An in-line roller skate 1 generally comprises from two to six wheels 2, more particularly four or five, mounted aligned, each turning about an axis 5 mounted on a frame 6. The frame 6 on which are mounted the axes of rotation 5 of the wheels is itself mounted detachable or fixed on the sole 7 of a skate shoe 8.

The principal improvement corresponding to one of the essential means of the invention consists in mounting the axis of rotation 5 of at least the front wheel 9 displaceable in operation according to a linear course along an axis 10 preferably slightly inclined relative to the vertical 11, for example along an elongated slot opening 12 formed in the side walls 13, 14 of the frame 6 on which are mounted the axes of rotation 5 of the wheels.

Figure 3:
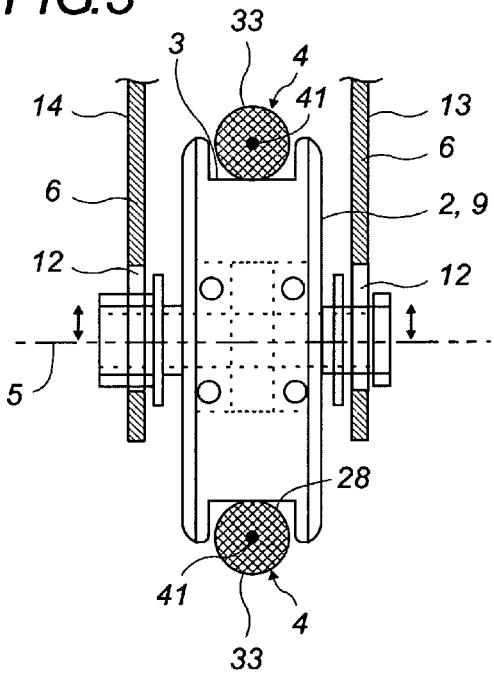
FIG. 3 is a cross-sectional view of a roller skate at the level of a front wheel, the axis of rotation of which is mounted sliding in a slot having the effect of suspension according to the invention.
Figure 10:
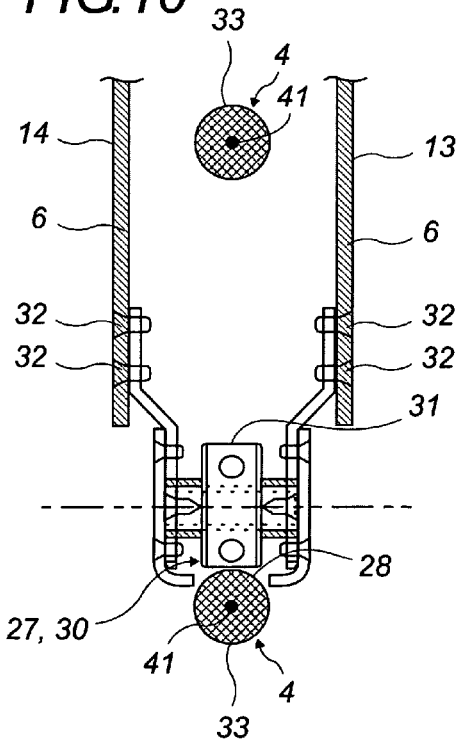
FIG. 10 is a cross-sectional view of a roller skate at the level of a smooth bearing roller on the internal face of the lower portion of the endless rolling support according to the invention.
Figure 4:
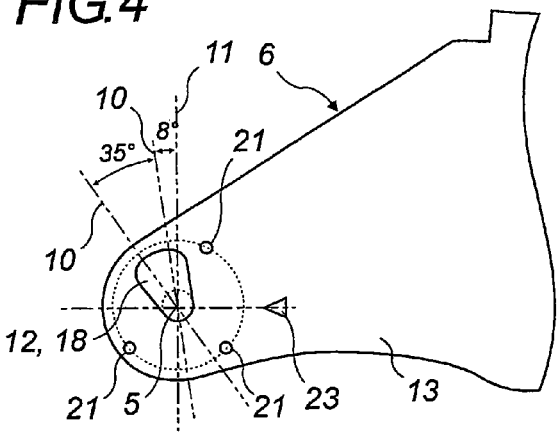
FIG. 4 is a detailed profile view of the front portion of the frame on which the wheels are mounted according to a variant of the invention, comprising a means of adjustment of the inclination of the effect of suspension for the axis of rotation of the front wheel.
Figure 5:
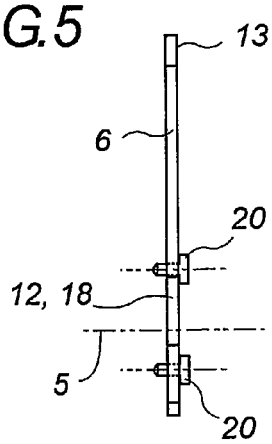
FIG. 5 is a front view corresponding to FIG. 4.
Figure 6:
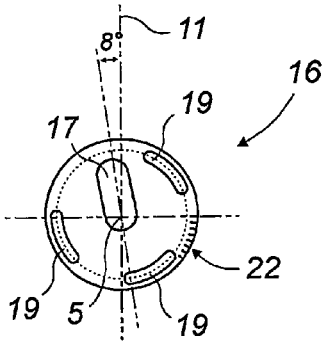
FIG. 6 is a profile view of a pivoting adjusting disk constituting the means for adjustment of the inclination of the course of the axis of rotation of the front wheel.
Figure 7:
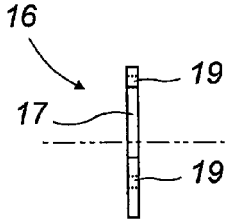
FIG. 7 is a front view corresponding to FIG. 6.
Figure 8:
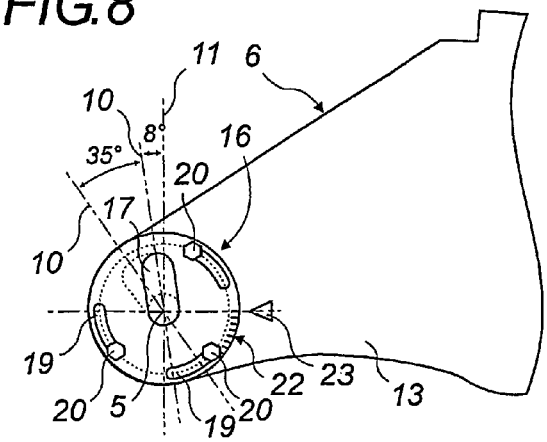
FIG. 8 is a detail profile view in which the various elements shown in FIGS. 4 and 6 are assembled.
Figure 9:
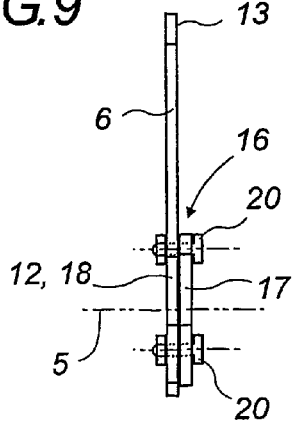
FIG. 9 is a front view corresponding to FIG. 8.

A front wheel 9, the axis of rotation 5 of which is mounted displaceable, is shown in section in FIG. 3.

Figure 2:
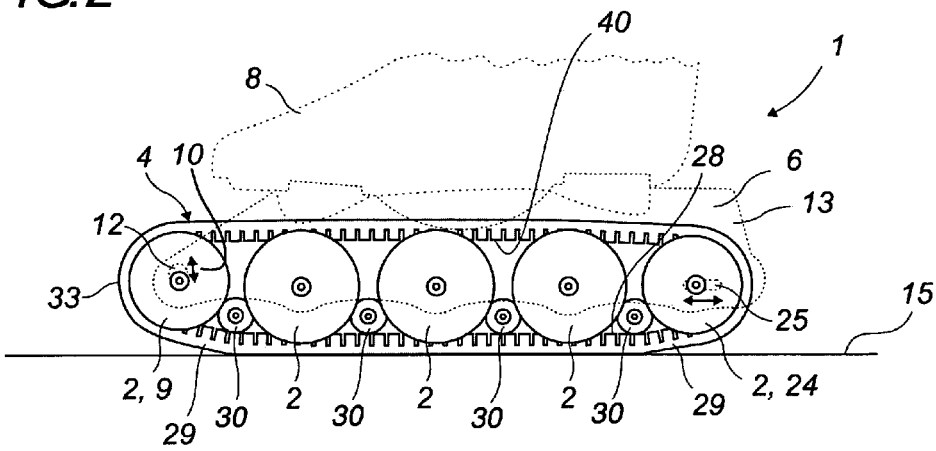
FIG. 2 is a view similar to that of FIG. 1 but in which, for reasons of clarity, certain elements have been omitted while others are shown in phantom.

Under the weight of the user, when the skate 1 passes over uneven ground 15 or over a small obstacle, displacement of the axis of rotation 5 of the wheel 2, 9 in pushing in upward, has a cushioning effect that reduces the impact, as is shown by a black arrow in FIG. 2.

The slot 12 formed in the side walls 13, 14 of the frame 6 on which the wheels are mounted preferably is inclined forward according to a fixed or modifiable angle, making it possible to modify, in adjustable fashion, the direction of displacement of the front wheel 9 and the cushioning force according to the weight of the user or the nature of the ground 15 on which it is rolling. In effect, a slot 12 having axis 10 near the vertical 11 allows a scantily cushioned rise of the front wheel 9, particularly adapted to users of low weight or to very rough ground, while a slot 12 having inclined or more inclined axis 10 procures a more cushioned and hence difficult rise of the latter, particularly adapted to users of heavy weight or to perfectly smooth ground.

The course of the axis of rotation 5 of at least the front wheel 9 being displaced in the slot 12 formed in the side walls of the frame preferably is inclined forward. In this case, return to position of the axis of rotation 5 of the wheel 2, 9 is made by means of the kinematic connection provided by the endless rolling support 4 of belt type. In effect, the latter 4 preferably is mounted taut on the wheels 2 of the skate and consequently forces the axis of rotation 5 of the wheel 2, 9 downward into the slot 12 formed in the side walls 13, 14 of the frame 6.

When the axis of rotation 5 of the front wheel 9, mounted sliding, rises in the slot 12 formed in the side walls 13, 14 of the frame 6, the shape of the perimeter that affects the endless rolling support 4 is temporarily modified, for example by spatial deformation or by elastic elongation, then returns to its initial conformation of equilibrium. It will be noted that according to the spatial configuration of the wheels 2, shown notably in FIGS. 1 and 2, the endless rolling support 4 is able to provide all or some of the force of recall necessary for the effect of suspension by simple spatial deformation of its perimeter, without necessarily being made of an elastic material.

Thus, the axis of rotation 5 of the front wheel 9 can be mounted with effect of suspension without its being necessary to use another means making it possible to obtain elastic recall, such as by springs or the like.

However, according to another variant of the invention, notably when the slot 12, formed in the side walls 13, 14 of the frame 6 on which the wheels 2 are mounted, is inclined toward the rear (not shown), it is possible to provide an elastic recall force, for example in the form of springs or the like, to recall the axis of rotation of at least one wheel 2, preferably the front wheel 9, in low position in the slot 12 formed in the side walls 13, 14 of the frame 6.

This solution, however, is less advantageous because it is more fragile and more costly.

FIGS. 4 to 9 detail a variant according to which the angle of inclination of the slot 12 can be adjusted. According to this variant, the cushioning device of the front wheel 9 comprises a pivoting adjusting disk 16 with adjustable inclination and having a slot 17 provided for passage of the axis of rotation 5 of the wheel 2, 9 mounted sliding along this slot, this axis 5 likewise passing into an enlarged opening 12, 18 formed in the side walls 13, 14 of the frame 6 on which the wheels 2 are mounted. This pivoting adjusting disk 16 likewise has openings 19 in an arc for passage of guide and locking screws 20, serving as a guide for the pivoting movement. In this variant, the enlarged opening 12, 18 formed in the side walls 13, 14 of the frame 6 is provided for passage and displacement of the axis of rotation 5 of the front wheel 9 according to various angles of inclination 10 provided by the pivoting adjusting disk 16. The frame 6 on which the wheels 2 are mounted likewise has threaded bores 21 for passage of the preceding guide and locking screws 20. For adjustment, the guide and locking screws 20 are loosened so that the user can orient the pivoting adjusting disk 16 according to the chosen inclination. This orientation is made by a pivoting of the disk 16, which pivoting is guided by the sliding of the openings 19 in an arc of the body of the disk 16 on the guide and locking screws 20. Once the inclination has been chosen, locking of the guide and locking screws 20 makes it possible to immobilize the pivoting adjusting disk 16 in position. Displacement of the axis of rotation 5 of the wheel 2, 9 at the time of cushioning will then be made according to the angle of inclination so fixed.

This angle of inclination relative to the vertical 11, for example toward the front, is between 0 and 45°, preferably between 8 and 35°. This angle preferably will be between 8 and 10° for children and about equal to 25° for adults.

According to a preferred variant of the invention, the angle of inclination may be indexed, for example, by means of graduations 22 situated on the pivoting adjusting disk 16, to which there corresponds a mark 23 provided on the frame 6 on which the wheels 2 are mounted or vice-versa.

The adjustable nature of this cushioning device is particularly advantageous in that the cushioning device may be standard, hence produced at low cost for all types of roller skates and for all sizes.

Although according to a preferred embodiment of the invention only the axis of rotation 5 of the front wheel 9 is mounted sliding, it is also possible to provide such an effect of suspension for other wheels 2 of the skate 1, for example by means of springs or the like (not shown).

A second improvement corresponding to a second original feature of the invention consists in mounting the axis of rotation 5 of the rear wheel 24 with substantially horizontal sliding in a substantially horizontal rectilinear slot 25, as is shown in FIG. 2. Indexing of the position of the axis of rotation 5 in the substantially horizontal slot 25 permits adjustment of the tension of the endless rolling support 4 around the wheels 2, 9, 24. This indexing is effected by means of a rapid, practical and low-cost mechanism, for example in known fashion by means of an eccentric 26 borne on the axis of rotation 5 of the rear wheel 24 as is shown in FIG. 1.

This mechanism 26 for adjustment of the tension of the endless rolling support 4 by the rear wheel 24 serves for adjustment of the tension of the endless rolling support 4 of belt type and for placement of the endless rolling support 4 or for replacement of the latter.

It is advantageously provided for the rear wheel 24, but also could be adapted to the front wheel 9.

Another improvement consists in adding at least one and preferably a plurality of intermediate rolling bearing elements 27 on the lower part of the skate 1 between the rolling wheels 2, in rolling bearing on the internal face 28 of the endless rolling support 4, in order to:

- improve retention and passage of the endless rolling support 4 between the wheels 2 by an intermediate guide;
- obtain greater bearing length of the endless rolling support 4 with the ground 5 by pushing the latter downward into its inclined lower portions 29; and
- keeping the endless rolling support 4 on a rectilinear path to prevent it from becoming deformed, for example in wavy fashion, following a hilly stretch.

These rolling bearing elements 27 preferably are in the form of rollers 30 or cylindrical rollers, smooth or grooved, for example of a size smaller than that of the wheels 2. Their external face 31 or their groove is in each instance borne on the endless rolling support 4. These rolling bearing elements 27 are each situated between two successive wheels 2.

The groove of each grooved roller constituting a rolling bearing element 27 preferably is of the same profile shape as that of the wheels 2.

In FIG. 1 bearing elements in the form of two smooth rollers 30 are shown, while in FIG. 2 these smooth rollers 30 are four in number. A smooth roller 30 according to a preferred embodiment of the invention is shown in section in FIG. 10.

Advantageously, the vertical position of these supplementary bearing rollers 27 may be adjustable, for example by means of adjusting screws 32.

Like the wheels 2, the axis of rotation of these suspension bearing elements 27 also may be mounted along slots.

Still another improvement consists in providing front wheels 9 and rear wheels 24 substantially smaller than the other wheels 2, the upper portion of the assembly of these wheels 2, 9, 24 being situated in substantially the same horizontal plane. Thus, as is shown more clearly in FIG. 2, the perimeter formed by the endless rolling support 4 has a substantially trapezoidal overall outline or spatial conformation, with an upper side longer than the lower side in contact with the ground 15, and these two parts being substantially rectilinear and parallel. This conformation allows a certain flexibility in retaining the endless rolling support 4 in its upper position and likewise permits spatial deformation of the perimeter that it forms as a whole.

When the axis of rotation 5 of a wheel 2, 9, mounted sliding, rises in the slot 12 formed in the side walls 13, 14 of the frame 6, the general outline of the perimeter formed by the endless rolling support 4 is temporarily deformed, for example by spatial deformation or by elastic elongation, and then returns to its initial conformation of equilibrium. It will be noted that according to the spatial configuration of the wheels 2, shown notably in FIGS. 1 and 2, the endless rolling support 4 is able to provide the force of recall necessary for the effect of suspension by simple spatial deformation of its perimeter, without necessarily being made of an elastic material.

As is shown in the figures, a principal improvement consists in using an endless rolling support 4, the external surface 33 of which has a hemicylindrical shape, namely, a section of semicircular shape. Thus, while having sufficient length making it possible to attenuate impacts produced by the presence of small obstacles or imperfections in the ground 15, the use of an endless rolling support 4 of this type considerably reduces the frictional surface between the endless rolling support 4 and the ground 15, which translates into greater speed and less fatigue for the user.

The endless rolling support 4 thus may have a total curvilinear section, for example round or oval, a fraction of the surface of which—called external surface 33—is in contact with the ground and permits a variety of incidences with the ground, the other—called internal surface 28—being in rolling bearing on the external face of each wheel. For this purpose, the wheels preferably are grooved wheels, each groove 3 having a section the form of which preferably corresponds substantially to that of the internal surface 28 of the endless rolling support 4.

In order to prevent the endless rolling support 4 of belt type from leaving the groove 3 of the wheels 2 or the intermediate rolling bearing elements 27, notably in case of major lateral force on the latter, the internal surface 28 of the endless rolling support 4, namely the surface 28 in contact with the wheels 2, may have a section of semicircular, trapezoidal, triangular, square, rectangular or other shape.

Figure 11:
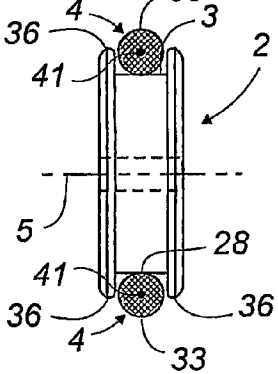
FIGS. 11 to 15 are detail cross-sectional views between two successive wheels of a roller skate according to the invention, in which the internal surface of the endless rolling support of belt type has sections of unlike shapes and in which the wheels have a groove of unlike shapes.
Figure 12:
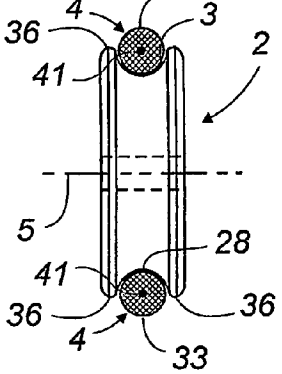
Figure 13:
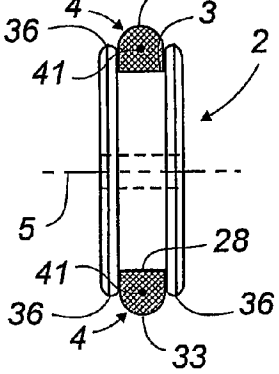
Figure 14:
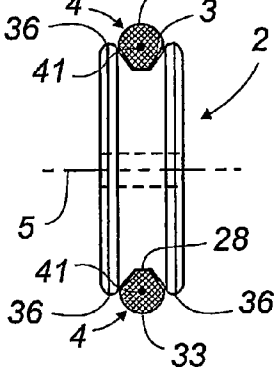
Figure 15:
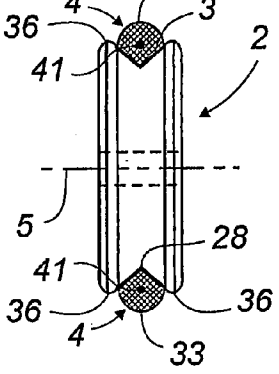
Figure 16:
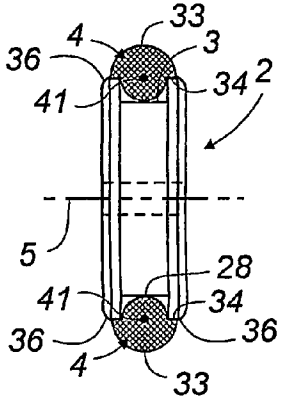
FIGS. 16 to 20 are views similar to FIGS. 11 to 15 but in which the external surface of the endless rolling support of belt type has a section, semicircular in shape, wider than that of the internal surface so as to present a bearing edge on the perimeter of the lateral faces of the wheels.
Figure 17:
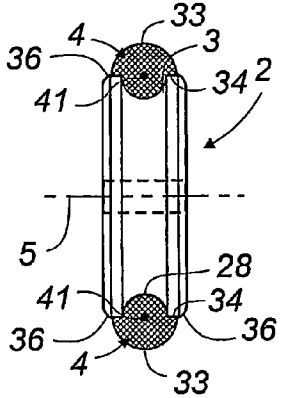
Figure 18:
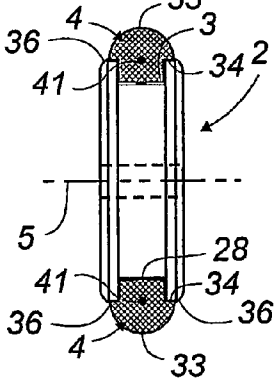
Figure 19:
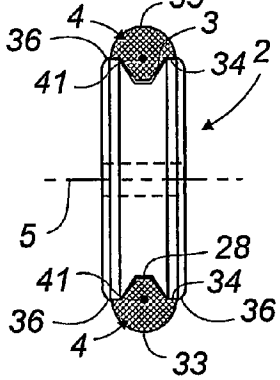
Figure 20:
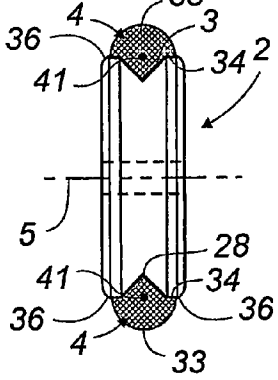

Various examples of shapes of section for the internal surface 28 of the endless rolling support 4 are shown in FIGS. 11 to 12, where the external surface 33 of the endless rolling support 4 has a section semicircular in shape.

As is shown in FIGS. 16 to 20, the external surface 33 of the endless rolling support 4 also may have a section having a radius greater than that of the internal surface 28, so that the hemicylindrical shape of the rolling surface 4 has an edge 34 bearing on the perimeter 36 of the lateral faces of the wheels 2. As previously described, the wheels 2 preferably, although not necessarily, have an external profile complementary to that of the internal surface 28 of the endless rolling support 4.

In order to prevent the endless rolling support 4 from leaving the grooves 3 of the wheels 2, it is also possible to provide one or more lateral guides 37 on the frame 6 on which are mounted the wheels 2 on either side of the endless rolling support 4. These lateral guides 37 may, for example, be situated between the wheels 2 of the skate 1, as shown in FIG. 1, where a skate 1 according to the invention comprises four lateral guides 37.

Figure 21:
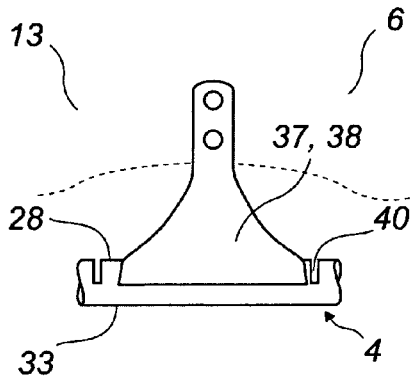
FIG. 21 is a detail profile view of a pair of lateral guides according to a variant of the invention, comprising a means preventing the endless rolling support from leaving its rolling guide.
Figure 22:
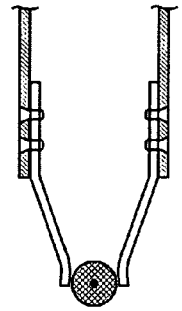
FIG. 22 is a cross-sectional view corresponding to FIG. 21.
Figure 23:
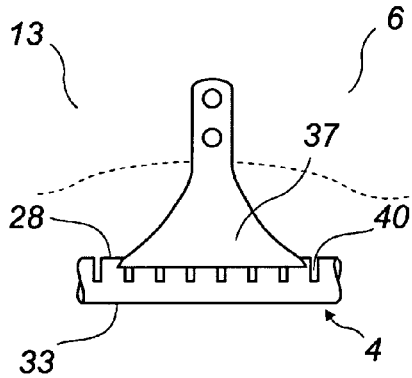
FIG. 23 is a detail profile view of a lateral guide according to another variant of the invention, comprising a means for retaining and guiding the endless rolling support in rolling.
Figure 24:
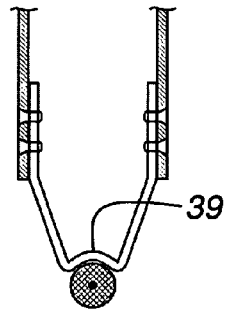
FIG. 24 is a cross-sectional view corresponding to FIG. 23.
Figure 25:
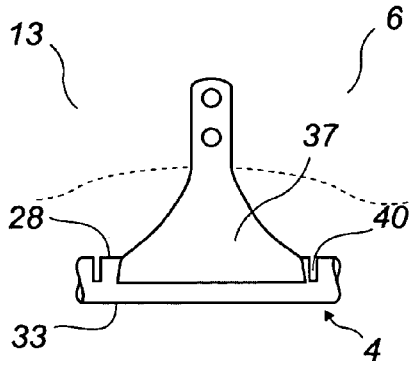
FIG. 25 is a detail profile view of a lateral guide according to a variant of the invention, comprising a means for retaining and guiding the endless rolling support in rolling.
Figure 26:
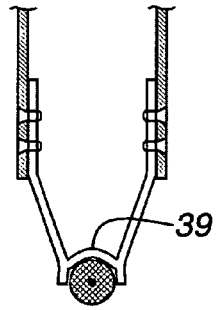
FIG. 26 is a cross-sectional view corresponding to FIG. 25.

As is shown in FIGS. 21 and 22, the lateral guides 37 may, for example, be present in the form of plates 38 fixed on the lateral sides 13, 14 of the frame 6 on which the wheels 2 are mounted, with a portion being prolonged downward, for example widened downward, so as to offer a great guide length for the endless rolling support 4 between the wheels 2 and without interfering with the latter. According to a variant, the lateral guides 37 may alternatively be configured as a single piece with the lateral sides 13, 14 of the frame 6 on which the wheels 2 are mounted (not shown).

As is shown in FIGS. 23 to 26, the lateral guides 37 may also be connected in their lower portion by a longitudinal bridge portion 39 located near the endless rolling support 4, just above the latter in its lower portion, but without contact. Preferably, the profile of the bridge portion corresponds substantially to that of the internal face 28 of the endless rolling support 4, so that the latter cannot lift up.

Another improvement consists in that in its internal surface 28, that is, the surface 28 in contact with the wheels 2, the endless rolling support 4 may have notches 40, preferably transverse and regular, the depth of which permits more rapid and much quieter rotation and deformation of the endless rolling support 4. In effect, these notches 40 likewise increase the overall flexibility of the endless rolling support 4 of belt type and promote its ability to bend without having to use a material that is more flexible and hence less resistant to wear.

In fact, thanks to the invention, it is possible to use a relatively firm endless rolling support 4 that does not need to have very great plasticity. It preferably is made of polymer material, advantageously having a central thread 41.

It will be noted that for reasons of simplification of the figures, an endless rolling support 4 of belt type comprising notches 40 is shown only in FIGS. 2, 21, 23 and 25.

The number of wheels 2 of the skate 1 according to the invention is not limitative. A greater number of them may exist, or their number may be reduced to two.

The invention described above concerns a skate 1 equipped with in-line wheels 2, thus constituting the principal means of the invention defining the inventive principle. It is understood that doubling this line of wheels 2 on the same skate 1 falls within the same inventive concept by reason of the application of the principle of duplication of the basic means.

Shown in the various figures is an in-line roller skate 1 comprising a single series of wheels 2 on which is mounted rolling a kinematic connection between the wheels or an endless rolling support 4, for example of belt type.

As indicated above, there may be considered, while remaining within the scope of the present invention, an in-line roller skate 1 comprising at least two successive rolling assemblies 42 and 43, arranged in line, of at least two wheels mounted aligned.

Figure 27:
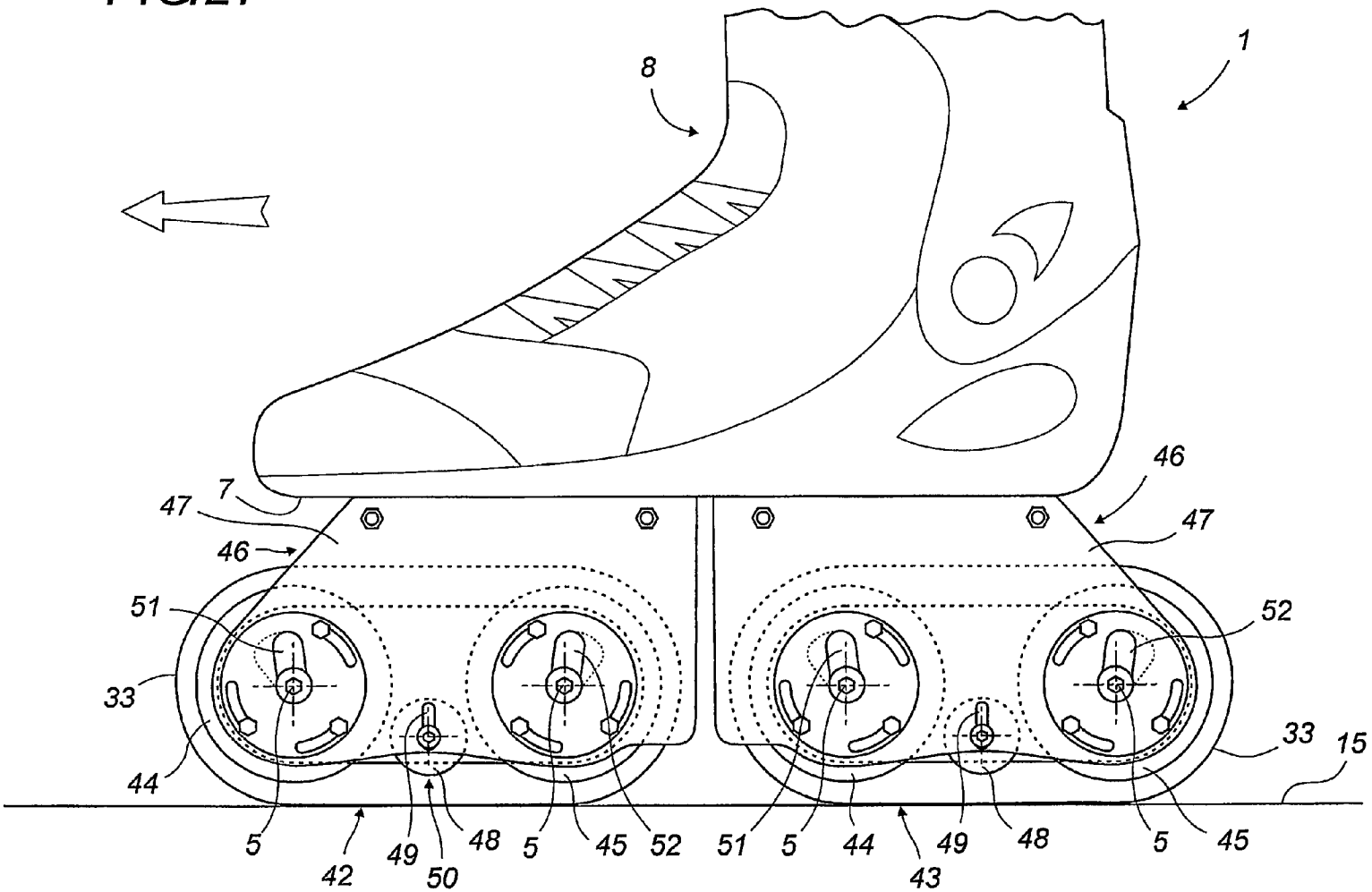
FIG. 27 is a profile view of a skate according to the invention, comprising two assemblies of two aligned wheels mounted one after the other.
Figures 28, 29:
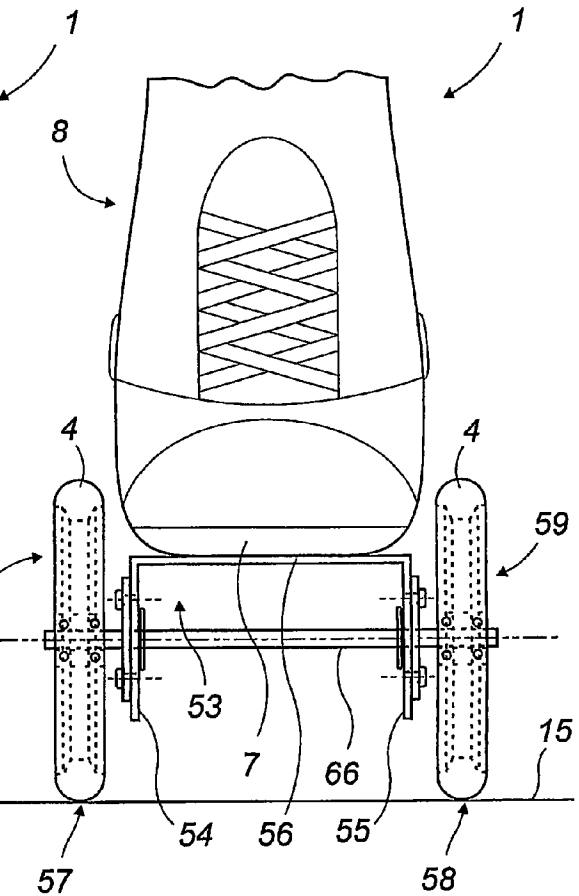
FIG. 28 is a profile view of a skate according to the invention, comprising two assemblies of two wheels mounted parallel on either side of the sole of a skate shoe.
FIG. 29 is a front view corresponding to FIG. 28.

Thus, FIG. 27 shows, by way of example, an in-line roller skate 1 comprising two successive in-line rolling assemblies 42 and 43, each comprising two wheels, one front wheel 44 and the other rear wheel 45.

In each instance, the axes of rotation 5 of each of the two aligned wheels 44 and 45 are maintained by a separate frame such as 46 formed, for example, by two parallel lateral covers, only one of the covers 47 of which is visible in the corresponding figure. The two wheels 44 and 45 of each rolling assembly 42 and 43 are in each instance separated by a pressure roller 48 having a movable axis along a slot 49 transverse to the direction of the kinematic connection 4 in its straight portions, forming an intermediate rolling bearing 50 in each instance.

In the in-line roller skate 1 comprising the two rolling assemblies 42 and 43 of the two aligned wheels 44 and 45, the axis of rotation 5 of the front wheel 44 of each of these two rolling assemblies of two wheels is mounted movable along a slot 51 with inclination adjustable by an adjusting device corresponding to the variant shown in FIGS. 4 to 9. The axis of rotation 5 of the rear wheels 45 of each of these two rolling assemblies is also mounted movable, for example in the same way as for the axis of the front wheel, along another slot 52 with inclination adjustable, for example, as above.

Another variant also falls within the same inventive scope. This is the one shown in FIGS. 28 and 29.

According to this variant, the shoe 8 is fixed on an inverted U-frame 53, formed of two covers 54 and 55 joined together by a plate 56 on which is fixed the sole 7 of the shoe 8. On this frame 53 there is mounted on each side a rolling assembly 57 and 58, for example identical or similar to those described above. These rolling assemblies 57 and 58 are made up of two wheels, one front wheel 59 and the other rear wheel 60, aligned and separated by a roller 61 having an axis of rotation the position of which is adjustable along a slot 62 transverse to the kinematic connection 4 in its straight portions. This roller 61 forms an intermediate rolling bearing point 63 between the wheels.

The axis of rotation 5 of the wheels 59 and 60 is in each instance movable along a slot 64 and 65 respectively, as in the device shown in FIGS. 4 to 9.

There may be considered a turning twin axis connecting each of the homologous wheels together, with the constraint that these wheels have to turn at the same speed.

There also may be considered, in each instance, a common axle 66 and wheels each mounted on a bearing at each of the ends of each common axle 66.

The axes 5 of the wheels 59 and 60 are connected together by a double longitudinal plate 67.

This embodiment with double rolling assembly 57 and 58 ensures better balance for the user but reduces the pleasure associated with keeping his own balance in skating, as well as the possibility of moving ahead rapidly.

Lastly, a stone guard 68 may be provided in the front part of the roller skate 1 of the invention, this guard 68 preferably being movable between a low position of use and a high position out of the way.

Figure 30:
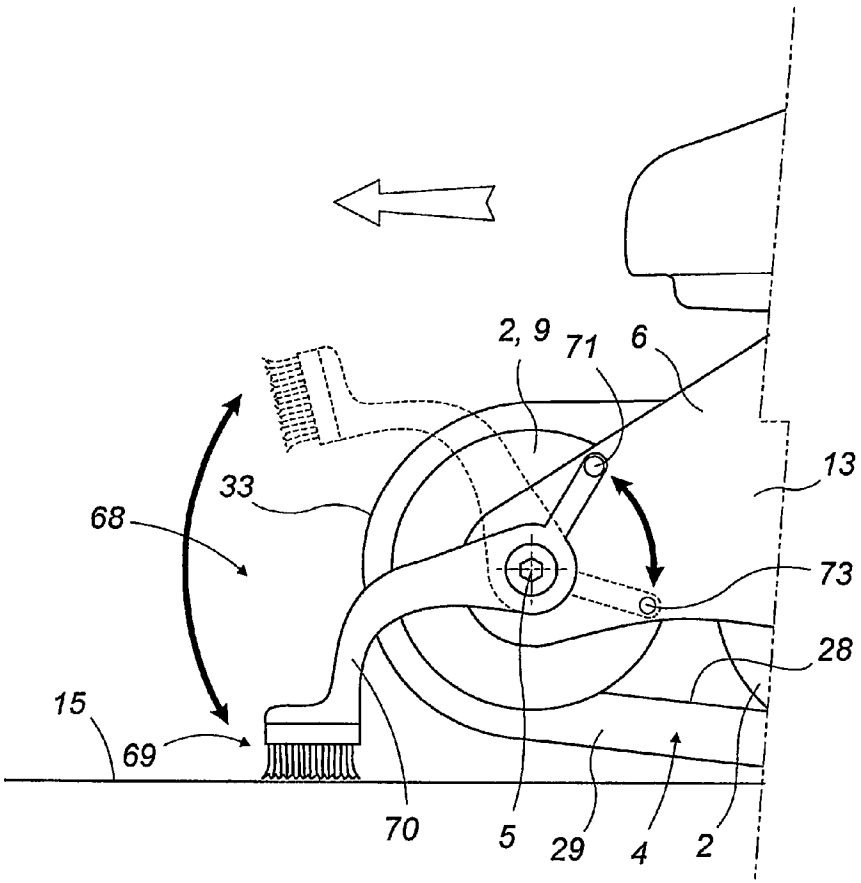
FIG. 30 is a detail profile view of the front part of a skate according to the invention, comprising a stone guard.

In FIG. 30, the low position is shown in solid lines, while the high position is shown in phantom in broken lines.

In low position, the stone guard 68 is provided to move away, for example by brushing, the bits of debris that are present on the ground 15 in the path of the endless rolling support 4: gravel, splinters of glass, cigarette butts, twigs, etc. This makes it possible to considerably increase the rolling comfort of the skates 1 and likewise makes it possible to prevent bits of debris from penetrating between the wheels 2, where they might impair the operation of the assembly.

Preferably, the stone guard 68 is present in the form of a brush-type assembly 69, for example substantially in the form of a snow plough, mounted on a support 70 retractable by swinging between a low position of use and a high position out of the way. The retractable support 70 is for example pivoting about the axis of rotation 5 of the front wheel 9 to be swung between these two positions.

Figure 31:
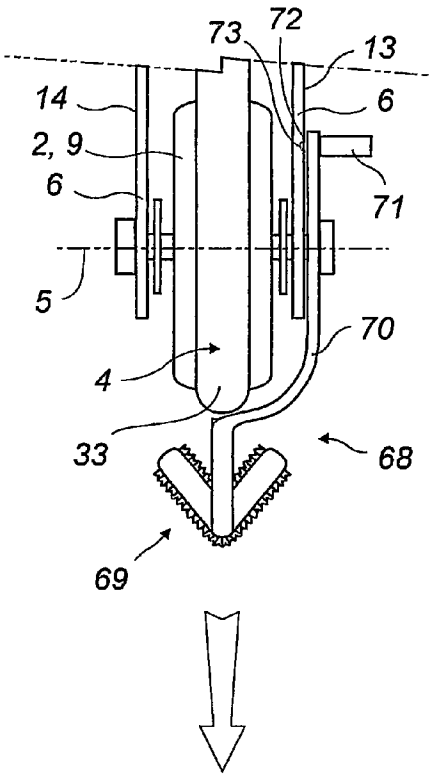
FIG. 31 is a detail view from above of the front part of a skate, comprising the stone guard of FIG. 30.

As is shown in FIGS. 30 and 31, in a preferred embodiment, swinging of the stone guard 68 is done manually by means of a small lever 71 fixed at the distal end of a retractable support 70 comprising a standard brush assembly 69 in its near front portion.

As is visible in FIG. 31, the extreme positions of swing into high and low position may be indexed and maintained, for example by means of a rounded projection 72 provided on the retractable support 70 and which cooperates with two housings 73 on the frame 6 on which the wheels 2 are mounted, these housings 73 being substantially complementary in shape to that of the rounded projection 72 and projection 72 provided on the retractable support 70 and which cooperates with two housings 73 on the frame 6 on which the wheels 2 are mounted, these housings 73 being substantially complementary in shape to that of the rounded projection 72 and the locations of which correspond to the extreme high and low positions of the course of the projection.

The invention obviously is not limited to the preferred embodiment previously described and shown in the various figures, the individual skilled in the art being able to make numerous modifications thereto and to devise other variants without exceeding either the range or the scope of the invention.

The invention claimed is:

1. An all-terrain roller skate, comprising:

a shoe member to be worn upon a person's foot;

a frame member attached to said shoe member and having a longitudinal extent;

a plurality of axles mounted upon said frame member and disposed transversely with respect to said longitudinal extent of said frame member;

a plurality of wheels respectively mounted in a rotatable manner upon said plurality of axles, wherein said plurality of wheels are disposed in a linearly serial manner along said longitudinal extent of said frame member;

an endless rolling support disposed within an endless loop about said plurality of wheels such that inner peripheral surface portions of said endless rolling support are disposed in contact with outer peripheral surface portions of said plurality of wheels while an outer peripheral surface portion of said endless rolling support is disposed in contact with a support surface upon which the person is to roller skate;

wherein the axle, of said plurality of axles, supporting the forwardmost wheel of said plurality of wheels disposed in said linearly serial manner along said longitudinal extent of said frame member, has opposite ends thereof disposed within a pair of substantially vertically oriented, forwardly inclined slots so as to be movable in upward and downward directions in order to effectively accommodate, in a substantially cushioned manner, irregularities in the support surface upon which the person is roller skating thereby rendering the roller skating operation more comfortable to the person roller skating.

2. The all-terrain roller skate as set forth in claim 1, wherein:

said pair of substantially vertically oriented, forwardly inclined slots are defined within sidewall portions of said frame member.

3. The all-terrain roller skate as set forth in claim 2, wherein:

said pair of substantially vertically oriented, forwardly inclined slots can have an inclination which is within the range of 0°-45° with respect to a vertical axis.

4. The all-terrain roller skate as set forth in claim 3, wherein:

said inclination of said pair of substantially vertically oriented, forwardly inclined slots is preferably within the range of 8°-35°.

5. The all-terrain roller skate as set forth in claim 4, wherein:

said inclination of said pair of substantially vertically oriented, forwardly inclined slots is preferably within the range of 8°-10° for children and is approximately 25° for adults.

6. The all-terrain roller skate as set forth in claim 1, wherein:

said endless rolling support is characterized by a predetermined amount of tension which normally maintains said opposite ends of said axle, supporting said forwardmost wheel of said roller skate, at bottom end portions of said pair of substantially vertically oriented, forwardly inclined slots, and will tend to return said opposite ends of said axle, supporting said forwardmost wheel of said roller skate, to said bottom end portions of said pair of substantially vertically oriented, forwardly inclined slots after said opposite ends of said axle, supporting said forwardmost wheel of said roller skate, have moved toward upper regions of said pair of substantially vertically oriented, forwardly inclined slots, when accommodating irregularities within the support surface upon which the person is roller skating.

7. The all-terrain roller skate as set forth in claim 1, further comprising:

enlarged openings, having a predetermined angular extents, defined within sidewall portions of said frame member; and a pair of disks, respectively mounted in an angularly adjustable manner upon said sidewall portions of said frame member, and having substantially vertically oriented, forwardly inclined slots defined therein for accommodating said oppositely disposed ends of said axle supporting said forwardmost wheel of said plurality of wheels and for angular adjustment with respect to said enlarged openings defined within said sidewall portions of said frame member, so as to permit the upward and downward movements of said axle, supporting said forwardmost wheel of said plurality of wheels, to occur at predeterminedly angularly different inclined positions whereby the degree of comfort imparted to the person roller skating can be predeterminedly adjusted.

8. The all-terrain roller skate as set forth in claim 7, wherein:

said pair of disks, having said substantially vertically oriented, forwardly inclined slots, respectively defined therein, can be angularly adjusted with respect to said side-wall portions of said frame member such that said substantially vertically oriented, forwardly inclined slots, respectively defined within said pair of disks, can have an inclination which is within the range of 0°-45° with respect to a vertical axis.

9. The all-terrain roller skate as set forth in claim 8, wherein:

said inclination of said pair of substantially vertically oriented, forwardly inclined slots is preferably within the range of 8°-35°.

10. The all-terrain roller skate as set forth in claim 9, wherein:

said inclination of said pair of substantially vertically oriented, forwardly inclined slots is preferably within the range of 8°-10° for children and is approximately 25° for adults.

11. The all-terrain roller skate as set forth in claim 7, further comprising:

a marker defined upon each one of said sidewall portions of said frame member; and said disks, angularly adjustably mounted upon said sidewall portions of said frame member, are provided with graduations which are adapted to be serially aligned with said markers defined upon said sidewall portions of said frame members such that said disks can be indexably adjusted with respect to said sidewall portions of said frame member whereby the inclinations of said slots, defined within said disks, can be predeterminedly angularly adjusted with respect to said enlarged openings defined within said sidewall portions of said frame member so as to predeterminedly adjust the degree of comfort imparted to the person roller skating.

12. The all-terrain roller skate as set forth in claim 1, wherein:

said endless rolling support comprises an endless belt.

13. The all-terrain roller skate as set forth in claim 1, wherein:

the axle, of said plurality of axles, supporting the rearwardmost wheel of said plurality of wheels disposed in said linearly serial manner along said longitudinal extent of said frame member, is movable in substantially backward and forward horizontal directions so as to effectively adjust the amount of tension of said endless rolling support disposed about said plurality of wheels.

14. The all-terrain roller skate as set forth in claim 13, further comprising:

an eccentric cam member pivotally mounted upon said frame member for operatively engaging said at least one axle of said plurality of axles, supporting said rearwardmost wheel of said plurality of wheels disposed in said linearly serial manner along said longitudinal extent of said frame member, so as to effectively move said at least one axle of said plurality of axles, supporting said rearwardmost wheel of said plurality of wheels disposed in said linearly serial manner along said longitudinal extent of said frame member, in said substantially backward and forward horizontal directions so as to effectively adjust said tension of said endless rolling support disposed about said plurality of wheels.

15. The all-terrain roller skate as set forth in claim 1, further comprising:

a plurality of roller bearings fixedly mounted upon said frame member, respectively disposed between successive pairs of said plurality of wheels, and having external surface portions thereof operatively engaged with inner peripheral surface regions of the bottom portion of said endless rolling support so as to effectively maintain said bottom portion of said endless rolling support in a rectilinear manner for travel over the support surface upon which the person is roller skating.

16. The all-terrain roller skate as set forth in claim 15, wherein:

each one of said plurality of wheels and said plurality of roller bearings has a substantially pulley-wheel configuration comprising a concave, peripherally grooved section defined within an external peripheral surface region of each one of said plurality of wheels and said plurality of roller bearings for accommodating said endless rolling support.

17. The all-terrain roller skate as set forth in claim 16, wherein:

the cross-sectional configuration of each one of said concave, peripherally grooved sections defined within an external peripheral surface region of each one of said plurality of wheels and said plurality of roller bearings for accommodating said endless rolling support is selected from the group substantially comprising a rectangle, a semi-circle, a trapezoid, and a triangle.

18. The all-terrain roller skate as set forth in claim 13, wherein:

said forwardmost wheel and said rearwardmost wheel have diametrical extents somewhat smaller than the diametrical extents of the other wheels of said plurality of wheels, however, the upper external peripheral portions of said forwardmost wheel and said rearwardmost wheel are disposed in a substantially coplanar manner with respect to the upper external peripheral portions of said other wheels of said plurality of wheels whereby said endless rolling support has a substantially trapezoidal configuration.

19. The all-terrain roller skate as set forth in claim 17, wherein:

the external peripheral surface portion of said endless rolling support has a substantially semi-circular cross-sectional configuration, whereas the internal peripheral surface portion of said endless rolling support can have a cross-sectional configuration which is selected from the group comprising that of a rectangle, a semi-circle, a trapezoid, and a triangle so as to correspondingly match the cross-sectional configuration of said concave, peripherally grooved sections defined within said external peripheral surface regions of each one of said plurality of wheels and said plurality of roller bearings.

20. The all-terrain roller skate as set forth in claim 16, further comprising:

a plurality of guide members fixedly mounted upon said frame member, respectively disposed between successive pairs of said plurality of wheels, and having external surface portions thereof operatively engaged with inner peripheral surface regions of the bottom portion of said endless rolling support so as to effectively maintain said bottom portion of said endless rolling support aligned in a substantially rectilinear manner with respect to the plurality of wheels so as to maintain said bottom portion of said endless rolling support within said grooved sections of said plurality of wheels.

21. The all-terrain roller skate as set forth in claim 1, wherein:

inner peripheral portions of said endless rolling support have notches defined therein so as to impart enhanced flexibility to said endless rolling support.

22. The all-terrain roller skate as set forth in claim 1, wherein:

said plurality of wheels comprise multiple separate assemblies wherein each wheel of a first assembly of said multiple separate assemblies of said plurality of wheels is mounted upon a separate frame member than each wheel of a second assembly of said multiple separate assemblies of said plurality of wheels.

23. The all-terrain roller skate as set forth in claim 22, wherein:

said plurality of wheels comprises four wheels; and said multiple assemblies comprises two in-line assemblies with each assembly comprising two wheels, a front wheel and a rear wheel, mounted upon first and second frame members.

24. The all-terrain roller skate as set forth in claim 23, further comprising:

a roller bearing, fixedly mounted upon each one of said first and second frame members, respectively disposed between said front wheel and said rear wheel of each one of said two roller assemblies, and having external surface portions thereof operatively engaged with inner peripheral surface regions of the bottom portion of said endless rolling support so as to effectively maintain said bottom portion of said endless rolling support in a rectilinear manner for travel over the support surface upon which the person is roller skating.

25. The all-terrain roller skate as set forth in claim 23, wherein:

a pair of substantially vertically oriented, forwardly inclined slots are defined within sidewall portions of each one of said first and second frame members; and oppositely disposed ends of axles, supporting said front and rear wheels of said two wheel assemblies, are disposed within said pair of substantially vertically oriented, forwardly inclined slots so as to accommodate vertically oriented upward and downward movements of said axles.

26. The all-terrain roller skate as set forth in claim 25, further comprising:

enlarged openings, having a predetermined angular extents, defined within sidewall portions of said frame member; and a pair of disks, respectively mounted in an angularly adjustable manner upon said sidewall portions of said frame member, and having substantially vertically oriented, forwardly inclined slots defined therein for accommodating said oppositely disposed ends of said axle supporting said forwardmost wheel of said plurality of wheels and for angular adjustment with respect to said enlarged openings defined within said sidewall portions of said frame member, so as to permit the upward and downward movements of said axle, supporting said forwardmost wheel of said plurality of wheels, to occur at predeterminedly angularly different inclined positions whereby the degree of comfort imparted to the person roller skating can be predeterminedly adjusted.

27. The all-terrain roller skate as set forth in claim 1, wherein:

said plurality of wheels comprises only two wheels, a front wheel and a rear wheel, mounted upon a single frame member and having a bearing roller interposed between said front and rear wheel members.

28. The all-terrain roller skate as set forth in claim 1, further comprising:

a stone guard mounted upon a forward portion of said all-terrain roller skate so as to force debris to be removed from the region disposed immediately in front of said all-terrain roller skate as said person is roller skating.

29. The all-terrain roller skate as set forth in claim 28, wherein:

said stone guard is pivotally mounted upon said forward portion of said all-terrain roller skate so as to be movable between a lowered operative position and a raised inoperative position.

30. The all-terrain roller skate as set forth in claim 28, wherein:

said stone guard comprises a brush implement.

* * * * *